US006984057B1

(12) United States Patent
Rogers

(10) Patent No.: US 6,984,057 B1
(45) Date of Patent: Jan. 10, 2006

(54) SOUND, LIGHT AND STORAGE SYSTEM

(76) Inventor: Theresa L. Rogers, 601 Wesley Ave., Shreveport, LA (US) 71107

( * ) Notice: Subject to any disclaimer, the term of this patent is extended or adjusted under 35 U.S.C. 154(b) by 29 days.

(21) Appl. No.: 10/424,401

(22) Filed: Apr. 28, 2003

(51) Int. Cl.
*F21V 33/00* (2006.01)

(52) U.S. Cl. ..... 362/253; 362/125; 362/234; 362/249

(58) Field of Classification Search ..... 362/253, 362/125, 127, 130, 131, 133, 234, 249, 806, 362/85–88; 312/9.1, 8.16, 223.1, 237
See application file for complete search history.

(56) References Cited

U.S. PATENT DOCUMENTS

| | | | | |
|---|---|---|---|---|
| 1,440,906 A | | 1/1923 | Bouza | |
| 3,660,591 A | | 5/1972 | Schultz et al. | 174/70 R |
| 3,803,396 A | | 4/1974 | Damico | 240/2 R |
| 3,921,345 A | | 11/1975 | Damico | 52/28 |
| 3,934,284 A | | 1/1976 | Paletta et al. | 5/280 |
| 4,104,710 A | | 8/1978 | Damico et al. | 362/130 |
| 4,352,149 A | * | 9/1982 | Stetler | 362/96 |
| 4,780,919 A | | 11/1988 | Harrison | 5/60 |
| 4,903,353 A | | 2/1990 | Park | 5/2 R |
| 5,054,139 A | | 10/1991 | Jones | 5/2.1 |
| 5,070,556 A | | 12/1991 | Gloger | 5/308 |
| 5,165,126 A | | 11/1992 | Jones | 5/414 |
| 5,459,893 A | | 10/1995 | Walters | 5/414 |
| 6,292,960 B1 | | 9/2001 | Bowling | 5/308 |
| 6,502,256 B1 | | 1/2003 | McNeil et al. | 5/308 |
| 6,634,768 B2 | * | 10/2003 | McKenzie et al. | 362/253 |
| 6,778,675 B2 | * | 8/2004 | Maruo | 381/335 |

* cited by examiner

*Primary Examiner*—John Anthony Ward
*Assistant Examiner*—Mark Tsidulko
(74) *Attorney, Agent, or Firm*—R. Keith Harrison

(57) ABSTRACT

A sound, light and storage system which includes a sound and light module that may be placed adjacent to a bed, couch or other furniture. Various speakers and lights are provided on the sound and light module. The speakers may be connected to various entertainment or other equipment including televisions, video players, compact disk (CD) players, digital video disk (DVD) players, radios, computers and/or stereo systems, for example. The lights, as well as the speakers or the entertainment or other equipment to which the speakers are connected, may be wired to a control panel provided on the sound and light module to enable a person lying or sitting on the bed or couch convenient control of the lights, speakers and/or equipment. Alternatively or in addition, the lights, speakers and/or equipment may be connected to a remote control module and/or wireless control device. The sound and light module may be provided adjacent to a storage module which is provided adjacent to the bed and may be used to store various articles or support a video, CD player, DVD player, telephone or a radio or stereo system, for example, for convenient access by a person lying on the bed. The bed may include a bed and storage unit which may be fitted with drawers for the storage of various articles beneath the bed.

14 Claims, 5 Drawing Sheets

SOUND, LIGHT AND STORAGE SYSTEM

FIELD OF THE INVENTION

The present invention relates to accessories for furniture such as beds and couches. More particularly, the present invention relates to a sound, light and storage system which includes a sound and light module that may be placed adjacent to a bed, couch or other item of furniture and is fitted with various sound speakers and lights which may be easily controlled by a person lying or sitting on the bed, couch or other furniture.

BACKGROUND OF THE INVENTION

Televisions and stereo systems of one type or another are found in the vast majority of homes across the country. In most cases, a television is supported on a dresser or other item of furniture beyond the foot of a bed or within viewing distance of a couch such that a person can easily watch the television while lying on the bed or sitting or lying on the couch. In recent years, "surround-sound" speaker systems, in which remote sets of speakers connected to a television and/or stereo are placed at various locations including behind the person lying on the bed or sitting on the couch, have exploded in popularity. In the "surround sound" speaker configuration, sound from the television or stereo emanates from multiple locations rather than one location in the room to provide a rich and dynamic sound experience which approximates that of a movie theater for the viewer or listener. Nowadays, televisions and stereos are typically controlled using a hand-held remote control device for convenience.

Many persons enjoy reading while lying on a bed or reclining or sitting on a couch. Typically, a reading lamp is placed on the side of the bed or couch to provide adequate lighting for the person as he or she reads. Additional "mood" lamps or lights may be placed around the room or near the bed for various effects. For example, art lamps may be provided on the ceiling or wall to illuminate a work of art hanging on the wall.

Various lighting and sound systems for beds and other furniture are known in the art. Patents of interest in this regard include U.S. Pat. No. 1,440,906, which discloses a bed attachment for holding a book as a person reads while reclining in bed. Various lighting units for hospital beds are disclosed in U.S. Pat. Nos. 3,660,591; 3,803,396; 3,921,345; 4,104,710; and 4,780,919. A stereo head board for beds is disclosed in U.S. Pat. No. 3,934,284. Beds equipped with entertainment centers are disclosed in U.S. Pat. Nos. 5,054,139; 5,165,126; and 5,459,893. Other patents of interest include U.S. Pat. Nos. 4,903,353; 5,070,556; 6,292,960; and 6,502,256.

SUMMARY OF THE INVENTION

The present invention is generally directed to a sound, light and storage system which includes a sound and light module that may be placed adjacent to a bed, couch or other furniture. Various speakers and lights are provided on the sound and light module. The speakers may be connected to various entertainment or other equipment including televisions, video players, compact disk (CD) players, digital video disk (DVD) players, radios, computers and/or stereo systems, for example. The lights, as well as the speakers or the entertainment or other equipment to which the speakers are connected, may be wired to a control panel provided on the sound and light module to enable a person lying or sitting on the bed or couch convenient control of the lights, speakers and/or equipment. Alternatively or in addition, the lights, speakers and/or equipment may be connected to a remote control module. The sound and light module may be provided adjacent to a storage module which is provided adjacent to the bed and may be used to store various articles or support a video, CD player, DVD player, telephone or a radio or stereo system, for example, for convenient access by a person lying on the bed. The bed may include a bed and storage unit which may be fitted with drawers for the storage of various articles beneath the bed.

BRIEF DESCRIPTION OF THE DRAWINGS

The invention will be better understood, by way of example, with reference to the accompanying drawings, in which.

DESCRIPTION OF THE PREFERRED EMBODIMENTS

Figure 1:
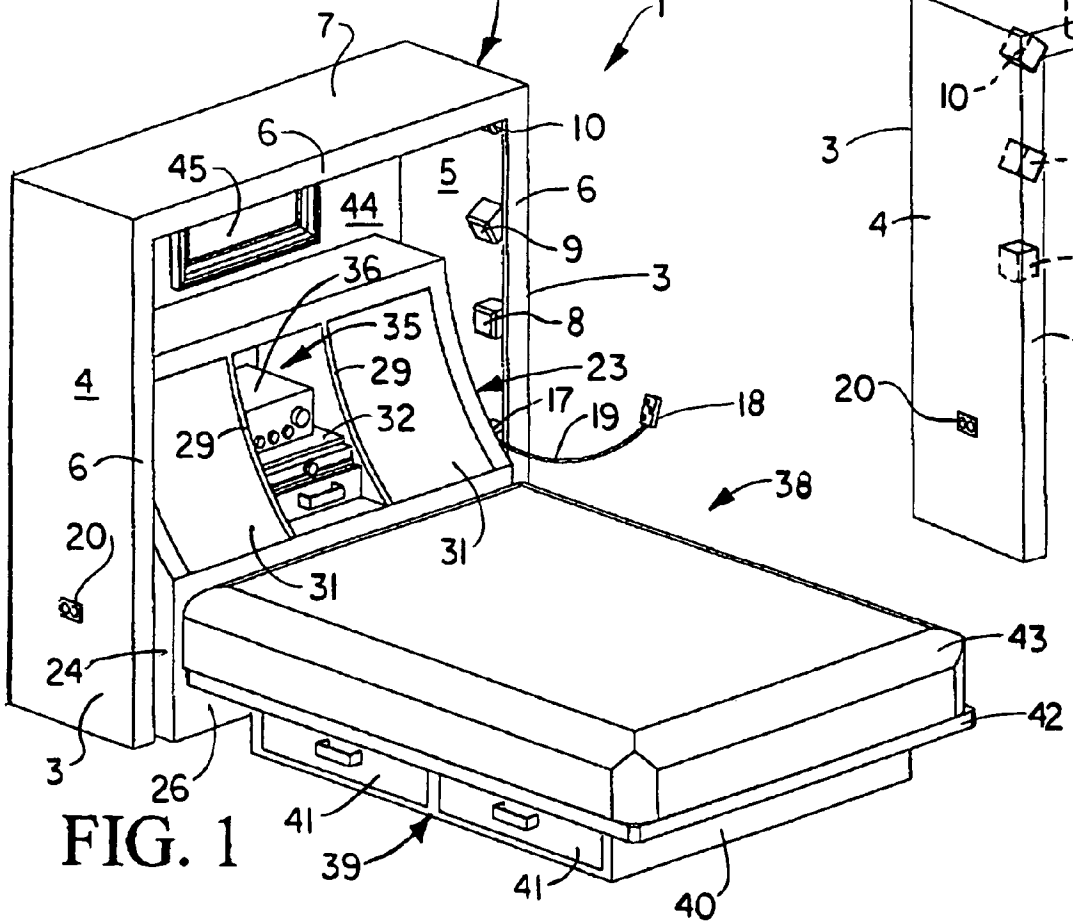
FIG. 1 is a front perspective view of an illustrative embodiment of the sound, light and storage system of the present invention.

Referring initially to FIG. 1 of the drawings, an illustrative embodiment of the sound, light and storage system, hereinafter referred to as the system, of the present invention is generally indicated by reference numeral 1. The system 1 includes a sound and light module 2 which, as will be hereinafter described, may be fitted with multiple sound speakers that may be connected to various entertainment system equipment such as a television, a compact disk (CD) player, a digital video disk (DVD) player, a video cassette recorder (VCR) player and/or a stereo system, in non-exclusive particular. The sound and light module 2 may further be provided with a light or lights which may include reading lights, mood lights and artwork illumination lights, in non-exclusive particular, as hereinafter further described. The light or lights, as well as the speaker or speakers, on the sound and light module 2 may be part of a home automation system in which the speakers and/or lights may be connected to a programming computer (not shown). The sound and light module 2 may be placed adjacent to a storage module 23 which is provided adjacent to a bed and storage unit 38, as shown, or alternatively, adjacent to a couch or sofa (not shown), as hereinafter described. When used herein to describe the positional relationships between the sound and light module 2 and the storage module 23, the term, "adjacent to" shall be construed to mean that the storage module 23 is positioned beneath, in front of, behind or beside the sound and light module 2.

Referring next to FIGS. 1–3 and FIG. 9 of the drawings, the sound and light module 2 typically includes a pair of supporting portions 3 which may be disposed in parallel, spaced-apart relationship to each other. Alternatively, the supporting portions 3 may be curved or have other configurations, as desired. Each of the supporting portions 3 may have an outer surface 4 and an inner surface 5 which faces the inner surface 5 of the opposite supporting portion 3. A typically horizontal spanning portion 7 spans the upper ends of the supporting portions 3. A trim strip 6 may be provided along the front edge of the supporting portions 3 and the spanning portion 7, respectively, as desired. The sound and light module 2 may be constructed of any substantially rigid or semi-rigid material, including but not limited to metal, wood and plastic, and may include various ornamental designs such as decorative molding or insignia, as desired.

Figure 2:
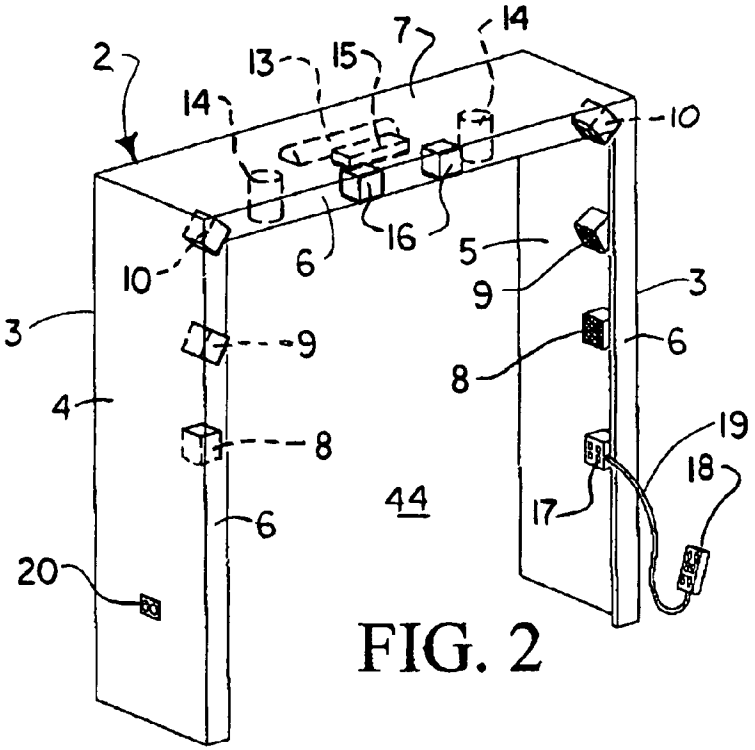
FIG. 2 is a front perspective view of a sound and light module of the sound, light and storage system.
Figure 3:
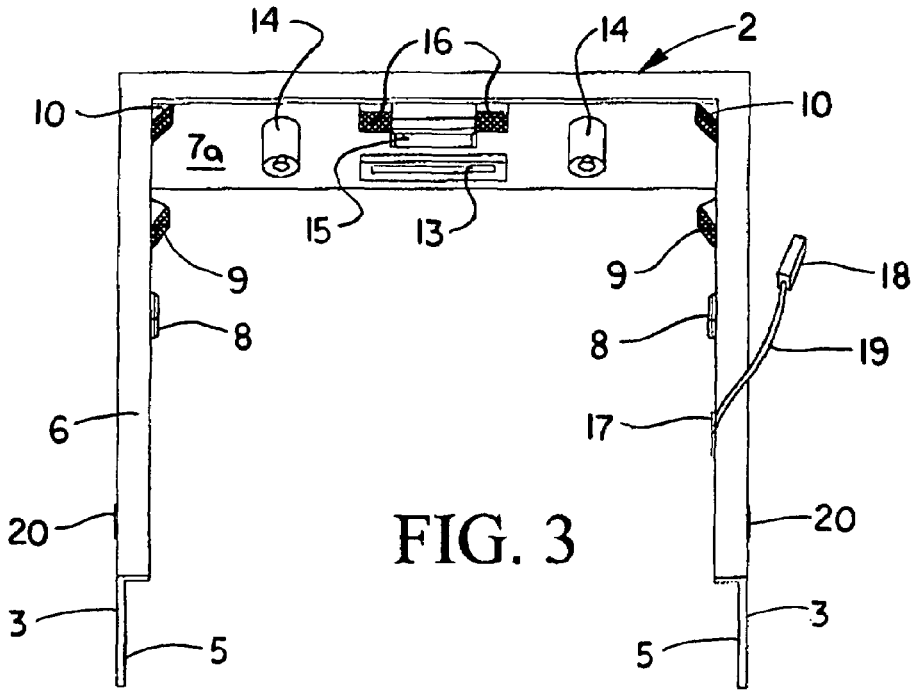
FIG. 3 is a bottom perspective view of a sound and light module of the sound, light and storage system.

As particularly shown in FIGS. 2 and 3, various sound speakers may be provided on the sound and light module 2. These may include, for example, a pair of bottom speakers 8, a pair of middle speakers 9 and a pair of top speakers 10, in non-exclusive particular, mounted on the inner surfaces 5, for example, of the respective supporting portions 3. One or a pair of overhead speakers 16 may additionally be mounted on the bottom surface 7*a* of the spanning portion 7. Moreover, the speakers may be confined entirely to either the supporting portions 3 or the spanning portion 7, or provided on both, as shown and may alternatively or additionally be provided on the exterior surfaces of the supporting portions 3 and/or spanning portions 7, of the sound and light module 2.

As further shown in FIGS. 2 and 3, various lights may be provided on the sound and light module 2. These may include, for example, one or a pair of reading lights 14; a mood light 15; and an artwork illumination light 13, each of which is provided typically on the bottom surface 7*a* of the spanning portion 7. The reading lights 14 are typically, although not necessarily, provided on opposite sides of the artwork illumination light 13, the mood light 15 and the overhead speakers 16, which may be grouped together at or near the longitudinal middle of the typically elongated spanning portion 7, as shown. However, it is understood that the artwork illumination light 13, the reading light or lights 14 and the mood light 15 the may be provided alone or grouped with each other typically on the bottom surface 7*a* of the spanning portion 7. Furthermore, the reading lights 14 may be wired such that each can be illuminated independently of the other. It is further understood that lights of alternative design and purpose may be provided on the sound and light module 2. The artwork illumination light 13, the reading light or lights 14, the mood light 15 and any additional light or lights may be provided on the inner surfaces 5 of the respective supporting portions 3, or distributed on both the bottom surface 7*a* of the spanning portion 7 and the inner surface 5 of either or both of the supporting portions 3. Like the speaker or speakers, the lights may alternatively or additionally be provided on the exterior surfaces of the supporting portion 3 and/or the spanning portion 7 of the sound and light module 2.

Figure 9:
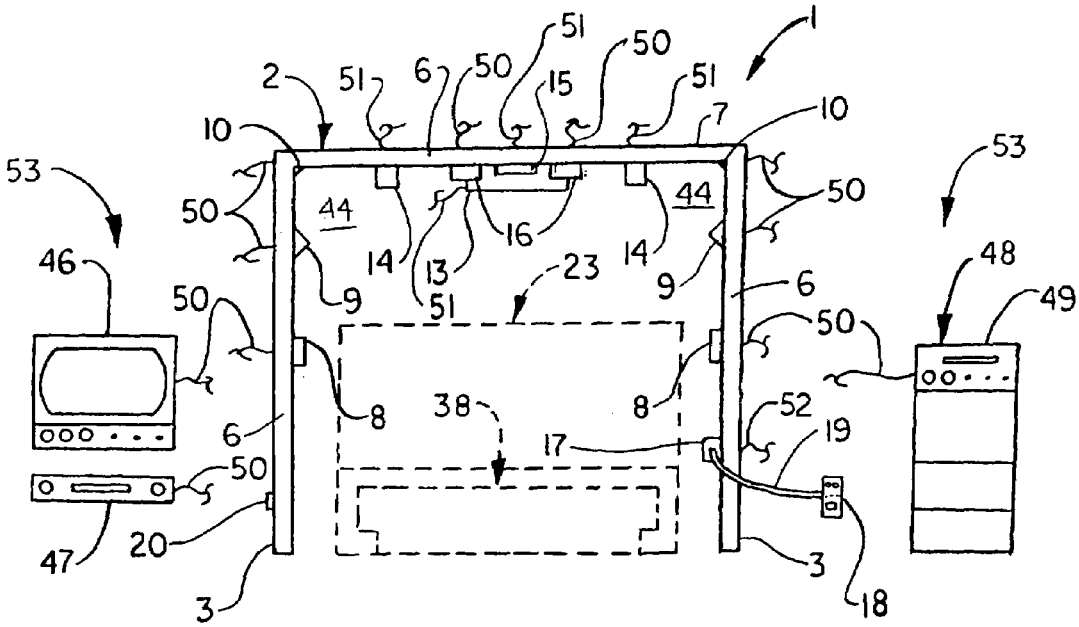
FIG. 9 is a schematic illustrating entertainment equipment connected to the various speakers of the sound and light module according to one embodiment of the invention.

As shown in FIG. 9, any or all of the bottom speakers 8, the middle speakers 9, the top speakers 10 and the overhead speakers 16, as well as any additional or alternative speakers provided on the sound and light module 2, may be connected, according to the knowledge of those skilled in the art, by speaker wiring 50 to various entertainment system or other equipment 53 such as a television 46, a digital video disk (DVD) player 47, a computer (not shown) and/or a stereo system 48 typically having a compact disk (CD) player 49, in non-exclusive particular. The speakers may be connected by control wiring 52 to a fixed control panel 17 provided typically on one of the supporting portions 3 of the sound and light module 2, and may further or alternatively be connected to a remote control module 18 that may be wired to the fixed control panel 17 through wiring 19. Moreover, the speakers may be controlled additionally or alternatively using a wireless control device (not shown). Accordingly, sound from a selected component of the entertainent or other equipment 53 may be broadcasted from the speakers, and the volume of the sound emanating from each speaker may be controlled by manipulation of the appropriate control element or elements on the fixed control panel 17 and/or the remote control module 18. The artwork illumination light 13, the reading lights 14 and the mood light 15, as well as any additional or alternative lights provided on the sound and light module 2, may be operably connected by light wiring 51 to the fixed control panel 17 and/or the remote control module 18 and/or may be energizable using the wireless control device. In another embodiment, each of the components of the entertainment or other equipment 53 may be wired directly to the fixed control panel 17 and/or the remote control panel 18 and/or may be operated using the the wireless control device. Accordingly, the volume of sound from the entertainment equipment 53 and broadcast from the speakers, as well as turning of the equipment 53 on and off, may be controlled by manipulation of the appropriate control elements of the fixed control panel 17 and/or the remote control module 18 and/or the wireless control device. It will be appreciated by those skilled in the art that the locations of the fixed control panel 17 and the remote control module 18 enable a person (not shown) lying on the bed and storage unit 38, hereinafter described, to conveniently control the equipment 53 and/or the volume of sound emanating from the speakers, as well as illumination of the various lights on the sound and light module 2. To accomplish that end, the fixed control panel 17 and/or the remote control module 18 and/or the wireless control device may be equipped with light dimmers (not shown), as desired, to facilitate varying the degree of illumination of each light. The remote control module 18 may be connected typically by wiring 19 to the fixed control panel 17, or alternatively, may be connected directly to the lights and to the speakers and/or entertainment or other equipment 53 connected to the speakers on the sound and light module 2. Accordingly, the remote control module 18 provides additional ease and flexibility to a user in operating the lights, controlling the volume of sound emanating from the speakers, and/or operating the equipment 53 to which the speakers are connected. The fixed control panel 17 and/or the remote control module 18 and/or the wireless control device may include either or both on/off and volume control elements for the entertainment and/or other equipment 53, as desired. An outlet 20 may further be provided on one or both of the supporting portions 3. The outlet 20 may be a standard 120-volt electrical outlet which is connected to electrical wiring (not shown) in a home or business, or alternatively, may be a telephone outlet, a cable television outlet or any combination of electrical, telephone and cable television outlets, for example.

Figure 4:
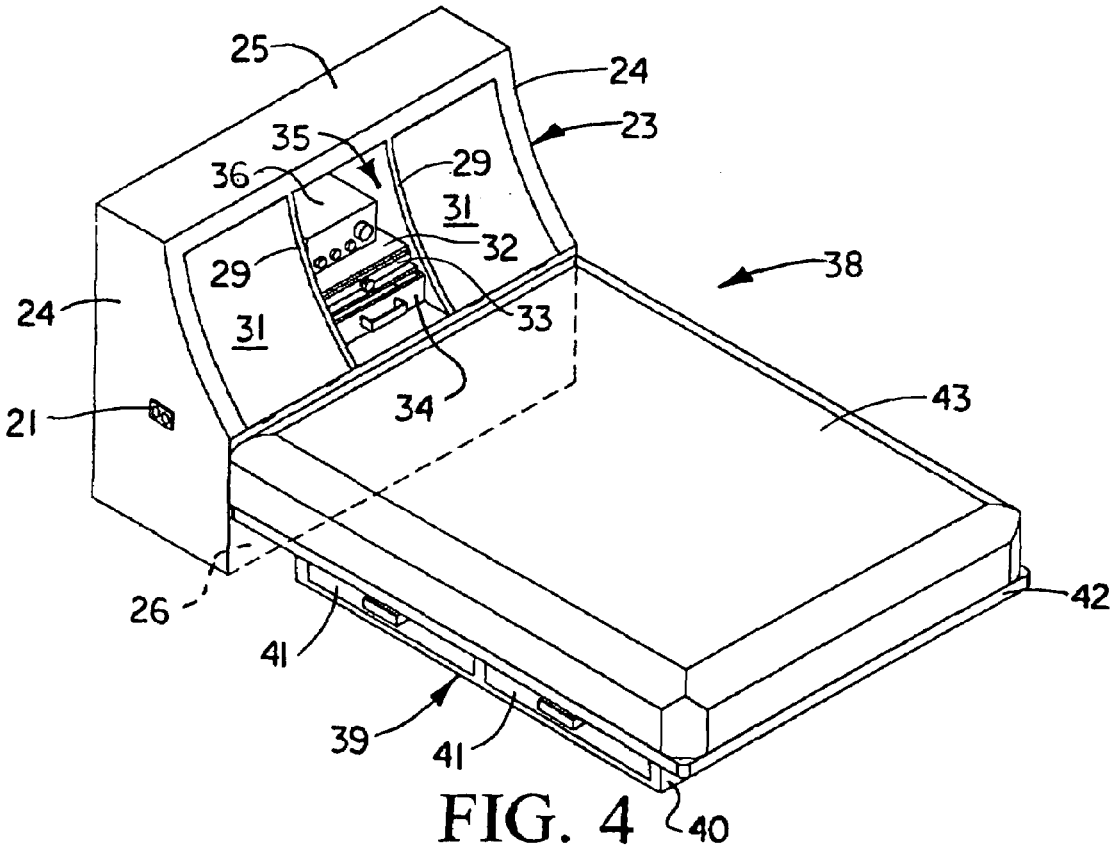
FIG. 4 is a front perspective view of an illustrative storage module of the sound, light and storage system, with a bed and storage unit shown positioned against the storage module.
Figure 5:
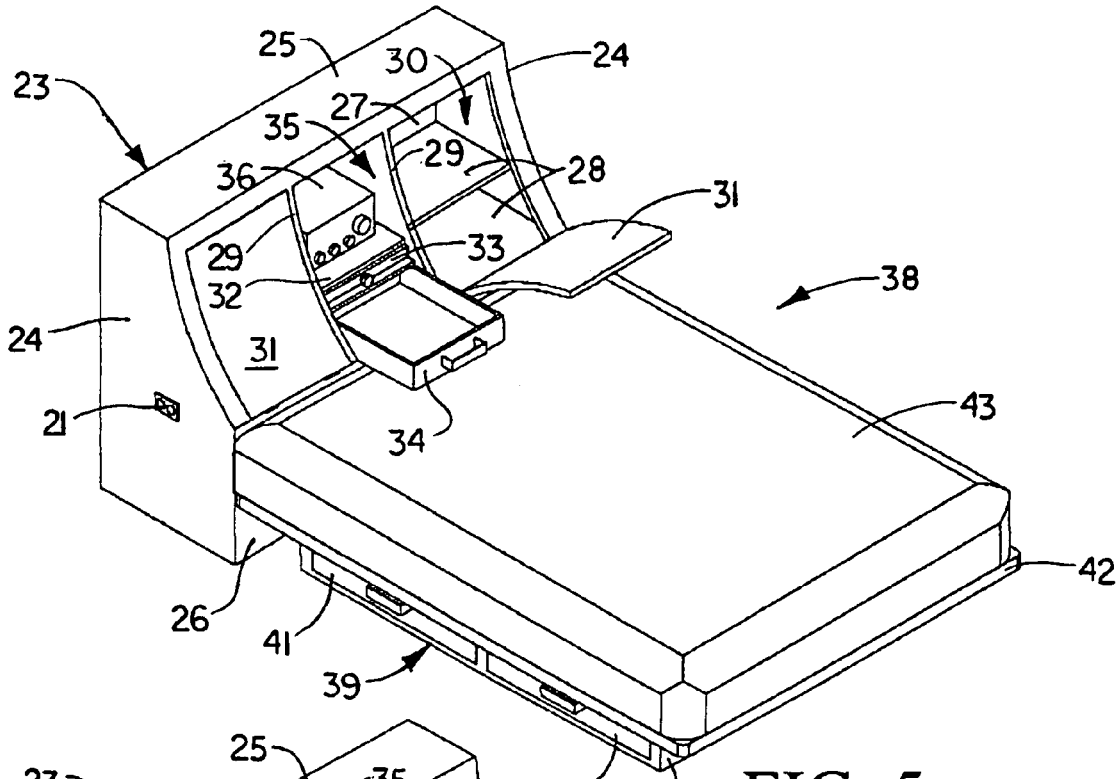
FIG. 5 is a front perspective view of an illustrative storage module, positioned against a bed and storage unit and illustrating a typical interior storage compartment of the storage module.

Referring next to FIGS. 1 and 4–6 of the drawings, the system 1 may further include a storage module 23 which typically fits adjacent to the sound and light module 2 or beneath the spanning portion 7 and between the supporting portions 3 of the sound and light module 2, as shown in FIG. 1. As hereinafter further described and further shown in FIG. 1, the head end of a bed support and storage unit 38 typically fits against the storage module 23. The storage module 23 typically includes a pair of spaced-apart side panels 24, a top panel 25 which spans the upper edges of the side panels 24, a front panel 26 which spans the bottom front edges of the side panels 24, and a rear panel 27 (FIG. 5) which spans the rear edges of the side panels 24. A pair of divider panels 29 which spans the front panel 26 and the rear panel 27 divides the interior of the storage module 23 into a pair of side storage compartments 30 (one of which is shown in FIG. 5) and a middle storage compartment 35. As further shown in FIG. 5, one or multiple shelves 28 may be provided in each of the side storage compartments 30. The bottom edge of a generally rectangular recliner panel 31, having a generally arcuate cross-sectional configuration and a concave outer surface, is hingedly attached typically to the upper edge of the front panel 26 and reversibly encloses each side storage compartment 30. Accordingly, each recliner panel 31 may selectively be pivoted between the closed position wherein the corresponding side storage compartment 30 is closed, and the open position wherein the interior of the corresponding side storage compartment 30, including objects (not shown) supported on the shelf or shelves 28, may be accessed. When the recliner panel 31 is closed, a person (not shown) lying or sitting on the bed and storage unit 38 is capable of reclining his or her back against the concave outer surface of the recliner panel 31, to read a book, for example. An outlet 21 may further be provided on one or both of the side panels 24 and/or on the front panel 26 and/or rear panel 27. The outlet 21 may be a standard 120-volt electrical outlet which is connected to electrical wiring (not shown) in a home or business, according to the knowledge of those skilled in the art, or alternatively, may be a telephone outlet, a cable television outlet or any combination of electrical, telephone and cable television outlets, for example.

Figure 6:
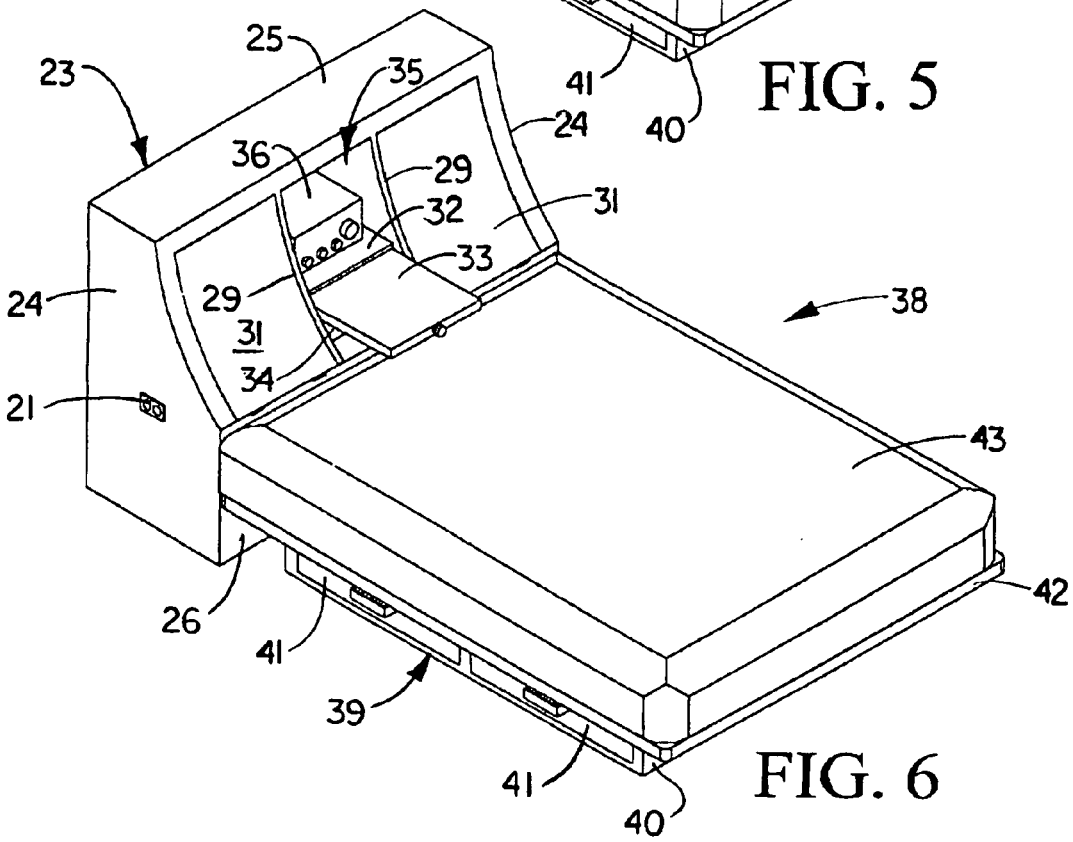
FIG. 6 is a front perspective view of an illustrative storage module, positioned against a bed and storage unit, with a pull-out board extended from the module in an illustrative embodiment.

A middle shelf 32 may be provided in the middle storage compartment 35, between the divider panels 29. As particularly shown in FIG. 6, a pull-out board 33 may be selectively extendible from the middle storage compartment 35, such as beneath the middle shelf 32, for example, to provide a writing surface for a person sitting on the bed and storage unit 38 or a surface for supporting a laptop computer (not shown) or other item, as desired. A drawer 34 may be selectively extendible from the middle storage compartment 35, typically beneath the pull-out board 33, for example, as shown in FIG. 5. The middle shelf 32 may be used to support a control console 36 for a stereo system or radio, for example, as shown in FIGS. 4–6, or books, a telephone and/or other objects, as desired. Alternatively, an electrical, cable or telephone outlet, or any combination of electrical, telephone and cable outlets (not shown), may be provided in the middle storage compartment 35 for conveninent connection of an electrical device, television, telephone, computer or the like to the outlet.

Figure 7:
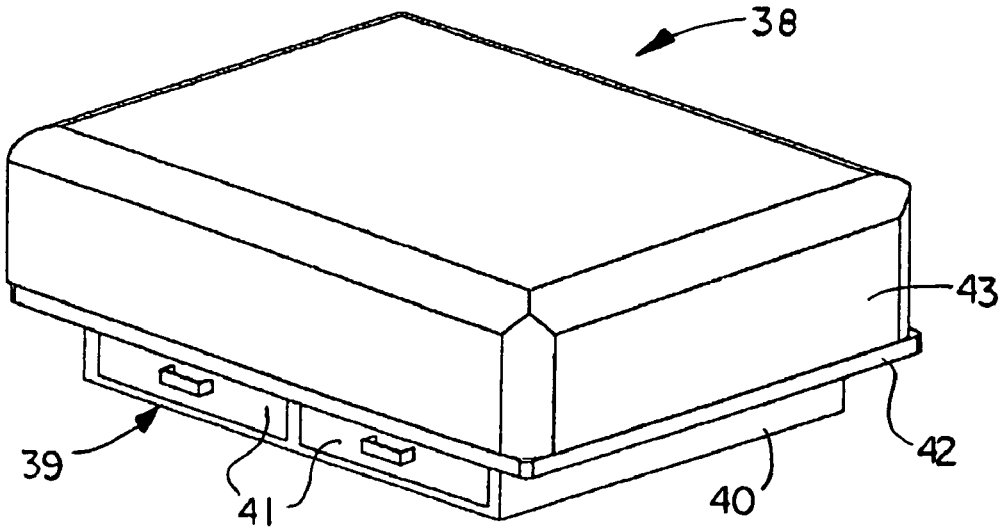
FIG. 7 is a perspective view of a bed and storage unit with a mattress supported thereon in an illustrative embodiment of the invention.
Figure 8:
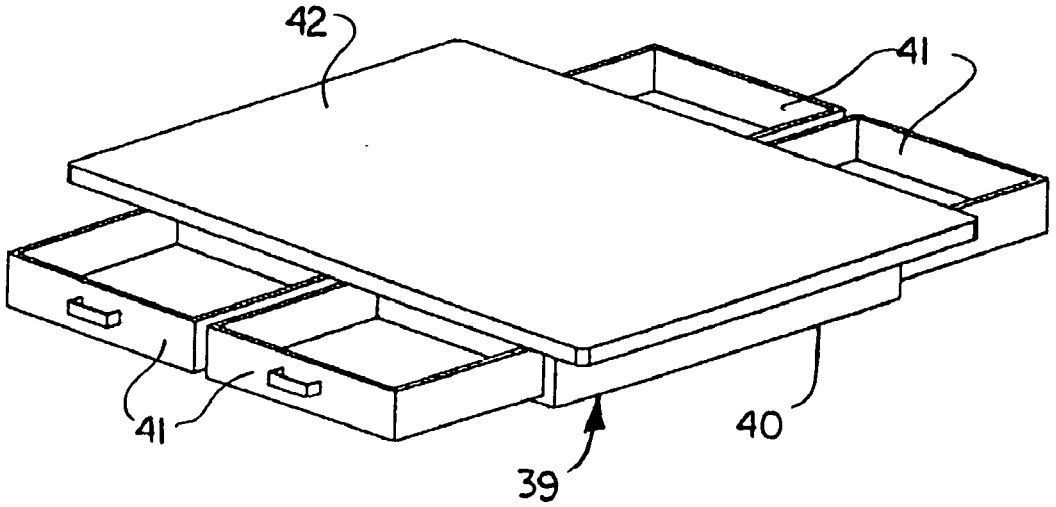
FIG. 8 is a perspective view of the bed and storage unit of FIG. 7, illustrating multiple drawers extended from the bed and storage unit.

Referring next to FIGS. 1, 7 and 8 of the drawings, the system 1 may further include a bed and storage unit 38, having a storage unit 39 which supports a mattress 43. The storage unit 39 may include a generally rectangular storage enclosure 40 having multiple drawers 41 selectively extendible therefrom. Accordingly, blankets (not shown) or other bedding or objects may be stowed in the drawers 41 of the storage enclosure 40, as desired. A mattress support panel 42 is provided on the upper edges of the storage enclosure 40, and the mattress 43 rests on the mattress support panel 42.

Referring again to FIGS. 1, 2 and 9 of the drawings, in an illustrative use of the system 1, the sound and light module 2 fits against a wall 44 in a bedroom of a home, for example. The storage module 23 fits against the wall 44, between the supporting portions 3 and beneath the spanning portion 7 of the sound and light module 2. The head end of the mattress support panel 42 on the storage unit 39 typically abuts against the front panel 26 of the sound and light module 2. The mattress 43 is supported by the mattress support panel 42, with the head end of the mattress 43 typically abutting against the front panel 26 of the storage module 23. The control console 36 of the stereo system or radio, for example, may be supported on the middle shelf 32 of the storage module 23 for convenient access by a person (not shown) sitting or lying on the bed 38. Alternatively, books (not shown) and/or other items such as a telephone, for example, may be supported on the middle shelf 32. The fixed control panel 17 and/or the remote control module 18 provide a person sitting or lying on the bed and storage unit 38 convenient access to control the various lights and the volume of sound emanating from the speakers provided on the sound and light module 2 and connected to the entertainment and/or other equipment 53. For example, by actuation of the appropriate control element on the fixed control panel 17 or remote control module 18, the person may energize the artwork illumination light 13 (FIG. 2) in order to illuminate artwork 45 hanging on the wall 44 beneath the spanning portion 7 of the sound and light module 2. In a similar manner, the person may energize the reading light or lights 14 (FIG. 2) to illuminate a book (not shown) as he or she reclines against the concave outer surface of one of the closed recliner panels 31 of the storage module 23. In the embodiment of the invention in which the equipment 53 is wired directly to the fixed control panel 17 and/or the remote control module 18, the various components of the entertaiment equipment 53 may be turned on and off, and the volume of the sound from the equipment 53 and emanating from the speakers, as well as illumination of the lights, may be controlled by manipulation of the appropriate control elements (not shown) on the fixed control panel 17 and/or the remote control module 18 and/or the wireless control device (not shown). Additionally, various electrical appliances such as a clock radio (not shown), for example, may be plugged into the outlet 20 on the supporting portion 3 of the sound and light module 2, or into the outlet 21 (FIG. 4) on the storage module 23, or in an outlet (not shown) provided in the middle storage compartment 35. In the event that the outlet 20 and/or outlet 21 and/or other outlet on the storage module 23 includes a telephone jack, a telephone (not shown) or computer modem and computer (not shown) may be plugged into the outlet 20 or outlet 21 and placed typically on the middle shelf 32 of the storage module 23. Moreover, in the event that the outlet 20 and/or outlet 21 and/or other outlet includes a cable television outlet, a television cable may be plugged into the outlet 20 or outlet 21 and/or other outlet and connected to a television set (not shown) for the service of cable or satellite television programming to the television, or a computer modem and computer may be connected to the outlet to provide internet access to the computer. In the event that the system 1 is included as a part of a home automation system, the various lights and/or speakers on the sound and light module 2, as well as the entertainment and/or other equipment to which the speakers are attached, may be connected to a computer (not shown) in a home or business to facilitate programming actuation of the lights, speakers and/or equipment, as desired.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. A sound, light and storage system comprising:

a sound and light module;

at least one sound speaker and at least one light carried by said sound and light module, said at least one sound speaker adapted for connection to sound-producing equipment;

a control component operably connected to said at least one sound speaker and said at least one light for controlling emanation of sound from said at least one sound speaker and illumination of said at least one light; and a storage module disposed adjacent to said sound and light module, said sound and light module comprising at least one storage compartment and at least one generally concave recliner panel carried by said storage module for closing said at least one storage compartment, respectively.

2. The system of claim 1 wherein said at least one light comprises at least one of an artwork illumination light, a reading light and a mood light.

3. The system of claim 1 wherein said at least one speaker comprises a plurality of speakers.

4. The system of claim 1 wherein said control component comprises at least one of a fixed control panel and a remote control module carried by said sound and light module.

5. The system of claim 1 wherein said at least one storage compartment comprises a plurality of storage compartments.

6. The system of claim 5 wherein said at least one light comprises at least one of an artwork illumination light, a reading light and a mood light.

7. The system of claim 5 wherein said at least one speaker comprises a plurality of speakers.

8. The system of claim 5 wherein said control component comprises at least one of a fixed control panel and a remote control module carried by said sound and light module.

9. A sound, light and storage system comprising:

a sound and light module;

at least one sound speaker and at least one light carried by said sound and light module, said at least one sound speaker adapted for connection to sound-producing equipment;

a control component operably connected to said at least one sound speaker and said at least one light for controlling emanation of sound from said at least one sound speaker and illumination of said at least one light;

a storage module disposed adjacent to said sound and light module;

a bed and storage unit disposed adjacent to said storage module; and at least one storage compartment and at least one generally concave recliner panel carried by said storage module for closing said at least one storage compartment, respectively.

10. The system of claim 9 wherein said at least one light comprises at least one of an artwork illumination light, a reading light and a mood light.

11. The system of claim 9 wherein said at least one speaker comprises a plurality of speakers.

12. The system of claim 9 wherein said control component comprises at least one of a fixed control panel and a remote control module carried by said sound and light module.

13. The system of claim 9 wherein said at least one storage compartment comprises a plurality of storage compartments.

14. The system of claim 9 wherein said bed and storage unit comprises a storage enclosure having at least one extendable drawer, a mattress support panel carried by said storage enclosure, and a mattress carried by said mattress support panel.

* * * * *